US007850384B2

(12) United States Patent
Sacks

(10) Patent No.: US 7,850,384 B2
(45) Date of Patent: Dec. 14, 2010

(54) CLEANING DEVICE

(75) Inventor: Roland Sacks, Bubikon (CH)

(73) Assignee: Avet AG, Ruti/Zurich (CH)

( * ) Notice: Subject to any disclaimer, the term of this patent is extended or adjusted under 35 U.S.C. 154(b) by 1143 days.

(21) Appl. No.: 11/512,038

(22) Filed: Aug. 28, 2006

(65) Prior Publication Data

US 2007/0020040 A1 Jan. 25, 2007

Related U.S. Application Data

(63) Continuation-in-part of application No. PCT/EP2005/004914, filed on May 6, 2005.

(30) Foreign Application Priority Data

Dec. 20, 2004 (DE) ..... 20 2004 019 888 U

(51) Int. Cl.
*A46B 11/00* (2006.01)

(52) U.S. Cl. ..... 401/140; 401/133; 401/138; 401/139; 141/351

(58) Field of Classification Search ..... 401/133, 401/134, 137–140; 141/351
See application file for complete search history.

(56) References Cited

U.S. PATENT DOCUMENTS 3,788,753 A * 1/1974 Stewart ..... 401/134
4,534,669 A 8/1985 Heck et al.
5,975,164 A * 11/1999 Whaley et al. ..... 141/351
6,981,533 B2 * 1/2006 Zorzo ..... 141/351

FOREIGN PATENT DOCUMENTS

DE 20 2004 019 888 U1 12/2004
EP 1 435 216 A2 7/2004

* cited by examiner

*Primary Examiner*—David J Walczak
(74) *Attorney, Agent, or Firm*—Volpe and Koenig, P.C.

(57) ABSTRACT

A fluid flow assembly includes a storage container connected to a fluid coupling and retaining cylinder. The connection is secured by a bayonet connection and walls between the bases of the container and cylinder. The storage container has a ball valve assembly disposed at its base, which includes an upper housing, a lower extension, and a ball valve axially disposed therein. The cylinder includes an axial hollow elongate fluid outlet on the base, co-axially aligned with an outlet port of the ball valve assembly of the container. The upper portion of the fluid outlet is a male coupling, which penetrates into the outlet port, when the container is connected to the cylinder, and axially displaces a valve ball from its closed position into an open position, enabling fluid flowing thru the ball valve assembly of the storage container, into the hollow fluid outlet of the cylinder, and downstream of it.

16 Claims, 5 Drawing Sheets

CLEANING DEVICE

CROSS REFERENCE TO RELATED APPLICATION

This application is a Continuation-In-Part of PCT patent application No. PCT/EP2005/004914 filed May 6, 2005, which claims the priority of German Utility Model No. 20 2004 019 888.6 filed Dec. 20, 2004, which are hereby incorporated by reference in their entirety.

BACKGROUND OF THE INVENTION

The invention relates to a fluid flow assembly and bottle for a cleaning device with a storage container for cleaning fluid, which can be secured in a detachable manner by means of a screw or bayonet connection to a fluid coupling and retaining cylinder with a fluid line which runs from the storage container to a fluid outlet, and with a female line coupling which has a coupling piece arranged at the storage container and a male coupling counter-piece arranged at the fluid coupling and retaining cylinder, whereby the container base facing the fluid coupling and retaining cylinder is provided with a container sealing piece.

A cleaning device of this type is known, for example, from German National Patent DE 2004 019 888 U1. This describes a cleaning device which exhibits a handling rod, at the floor-side end of which is a plate-shaped distribution surface in the form of a mop holder. Held on the handling rod is a storage container for cleaning or disinfecting agents. The contents of the storage container can be discharged via a fluid outlet, to be distributed via the distributor surface on the surface which is to be cleaned.

The storage container is held in a releasable manner on the fluid coupling and retaining cylinder, which in turn is secured to the handling rod. As can be seen in particular in FIG. 1 of DE 20 2004 019 888 U1, the storage container exhibits a container opening on the face side facing the holding element, which is delimited on the face side by a section which serves as a container lock and as a coupling piece. By means of this skin section, when the storage container is placed into fluid coupling and retaining cylinder, a cannula is guided into place as a coupling counter-piece, by means of which the cleaning fluid can emerge from the storage container.

A problem with such known cleaning devices, however, is the sealing tightness of the coupling piece with the coupling counter-piece, with the result that a risk arises of cleaning agent passing unintentionally into the fluid coupling and retaining cylinder and contaminating it, as well as the fact that the cleaning material is consequently discharged without control from the cleaning device. This problem therefore arises in providing a cleaning device of the type referred to above with which the sealing tightness in the connection area between the fluid coupling and retaining cylinder and the storage container is improved and any unintentional and uncontrolled emergence of cleaning fluid is largely avoided.

Other art known to the inventor includes U.S. Pat. No. 4,545,669 (1985) to Heck, which relates to a cleaning system having a flexible, not rigid, container for its cleaning fluid and, as such, does not address the mechanical issues of the present invention. EPO Publication 1,435,216 A2 (2004) relates to a gravity feed system, as opposed to a pump system, of a floor washing appliance. The requirements of fluid integrity of a pump system differ in several respects from those of the system set forth below.

The instant invention responds to those long felt needs in the art.

SUMMARY OF THE INVENTION

In one embodiment, the present invention is directed to a fluid flow assembly, which comprises a storage container having a base and a ball valve assembly axially disposed at the base along a longitudinal axis of the storage container; and a fluid coupling and retaining cylinder having a base and an axial hollow elongate fluid outlet co-axially aligned with the ball valve assembly of the storage container. The fluid outlet has a male coupling extending upwardly from the base of the cylinder. When the base of the storage container is connected to the fluid coupling and retaining cylinder, the male coupling penetrates into an outlet port of the ball valve assembly of the storage container, and axially displaces a valve ball of the ball valve assembly from a closed position into an open position, enabling a fluid flow from the storage container, through the ball valve assembly, into the hollow fluid outlet.

The ball valve assembly includes an upper housing protruding upwardly form the base of the container having an inlet aperture at an upper end of the housing, a lower extension protruding downwardly form the base of the container; and a valve spring, a valve ball, and an annular sealing gasket, all centrally, axially disposed within the upper housing and lower extension. The annular sealing gasket has a center opening, centrally and axially aligned with the valve ball, forming the outlet port of the ball valve assembly. When the ball valve assembly is in the closed position when the storage container is removed from the fluid coupling and retaining cylinder, wherein the valve ball seats on the annular sealing gasket and closes the outlet port of the ball valve assembly.

The fluid coupling and retaining cylinder further comprises a co-axial and concentric guide wall projecting upwardly from the base for complementally circumferential engagement with the lower extension of the ball valve assembly of the storage container. Moreover, the fluid coupling and retaining cylinder also comprises a mounting wall extending upwardly and axially from the base thereof, disposed at a radial distance interval from the guide wall, and the storage container further comprises a circumferential counter wall extending downwardly from the base of the storage container for axially engaging with the mounting wall of the cylinder.

In a further embodiment, the present invention is directed to a cleaning device, which comprises a handle rod having a distal end, a flat mop head connected to the distal end of the handle rod, a spray head and the instant fluid flow assembly.

It is an object of the invention to provide a fluid flow assembly for enhancement of reliability of continuous fluid flow in a non-gravity feed cleaning device.

It is another object to provide a fluid flow assembly of the above type having improved fluid integrity between a cleaning fluid storage bottle and downstream elements of the cleaning device, thus reducing the possibility of an accidental disconnection of the bottle.

It is a yet further object to provide a fluid flow assembly of the above type having improved ease of operator use and changing of a cleaning fluid bottle, including accuracy of polar registration of such bottles within a holding means therefore.

A still further object is to provide a fluid coupling system of the above type particularly adapted for use with a pump-powered floor cleaning device.

The above and yet other objects and advantages will become apparent from the hereinafter Brief Description of the Drawings, Detailed Description of the Invention and Claims appended herewith.

BRIEF DESCRIPTION OF THE DRAWINGS

An embodiment of a fluid flow assembly according to the invention is described in greater detail hereinafter, on the basis of the drawings, as follows.

It is noted that in the drawings like numerals refer to like parts throughout.

DETAILED DESCRIPTION OF THE INVENTION

Figure 1:
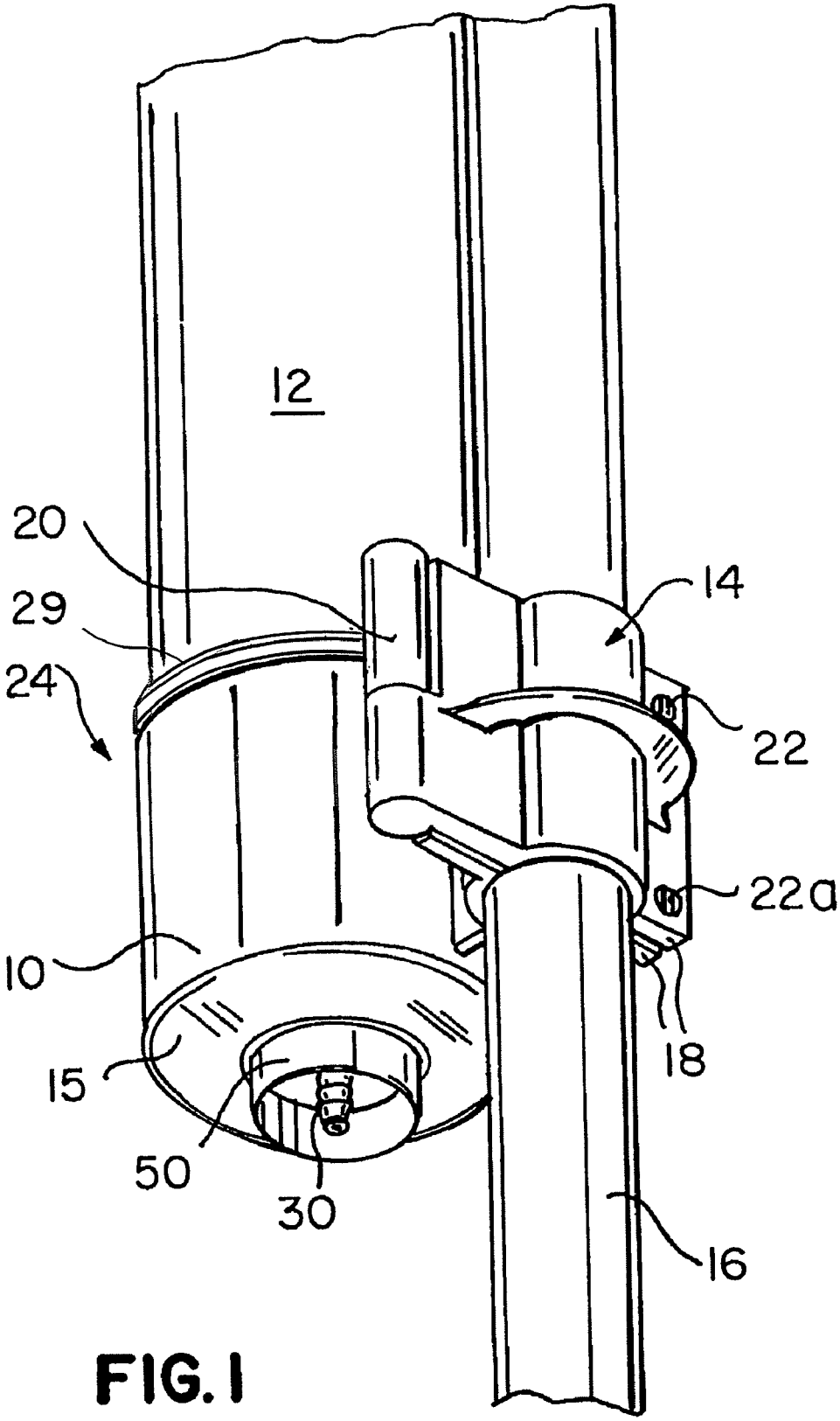
FIG. 1 shows a fluid flow assembly including a fluid coupling and retaining cylinder with a storage container of a cleaning device according to the invention.

Cleaning devices of many types (not shown in the drawings) including, particularly, one with which the inventive cleaning fluid flow assembly is intended to be used. Fluid flow assembly 1 includes a storage container 12 for holding a cleaning fluid and a fluid coupling and retaining cylinder 10 to which storage container 12 is connected (see FIGS. 1-4). The cylinder 10 utilizes a securing collar 14 for the retention of cylinder 10 to a handling rod 16 of the overall cleaning device (not shown). Securing collar 14 includes two clamping elements 18, connected to each other by hinge 20 at one side and screws 22/22*a* at the other, the cooperative effect of which is to facilitate the selectable securement and removal of cylinder 10 from rod 16.

In accordance with the present invention, storage container 12 is connected in a releasable manner to cylinder 10 using a bayonet fitting 24 in which bayonet projections 26 at opposite sides of the container are provided integrally thereon and are positioned relative to bayonet apertures 28 on a peripheral surface of cylinder 10. Circumferential ridge 29 controls the extent of insertion of storage container 12 into cylinder 10 axially, therefore, avoids improper positioning of the components which establish the fluid flow between storage container 12 and cylinder 10.

Figure 2A:
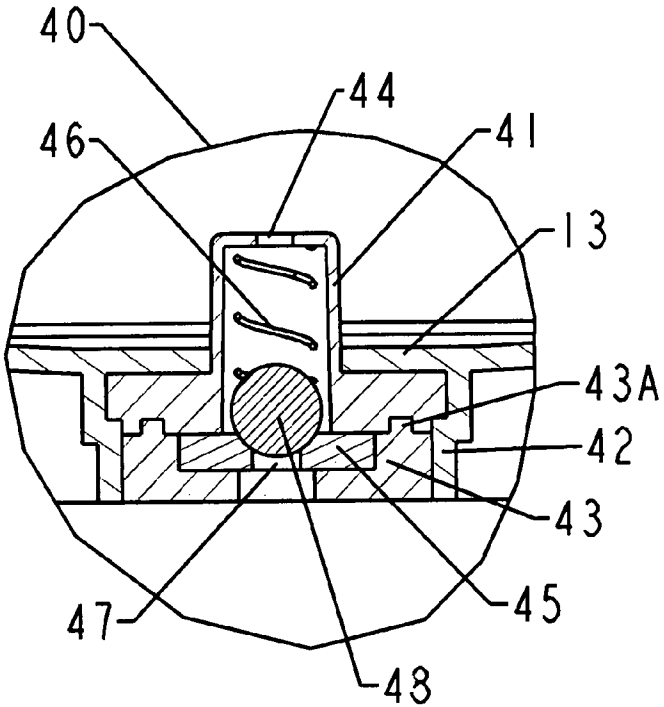
FIG. 2A is an enlarged view of the ball valve assembly of the storage container shown in FIG. 2, wherein the ball valve assembly is at its closed position.
Figure 2:
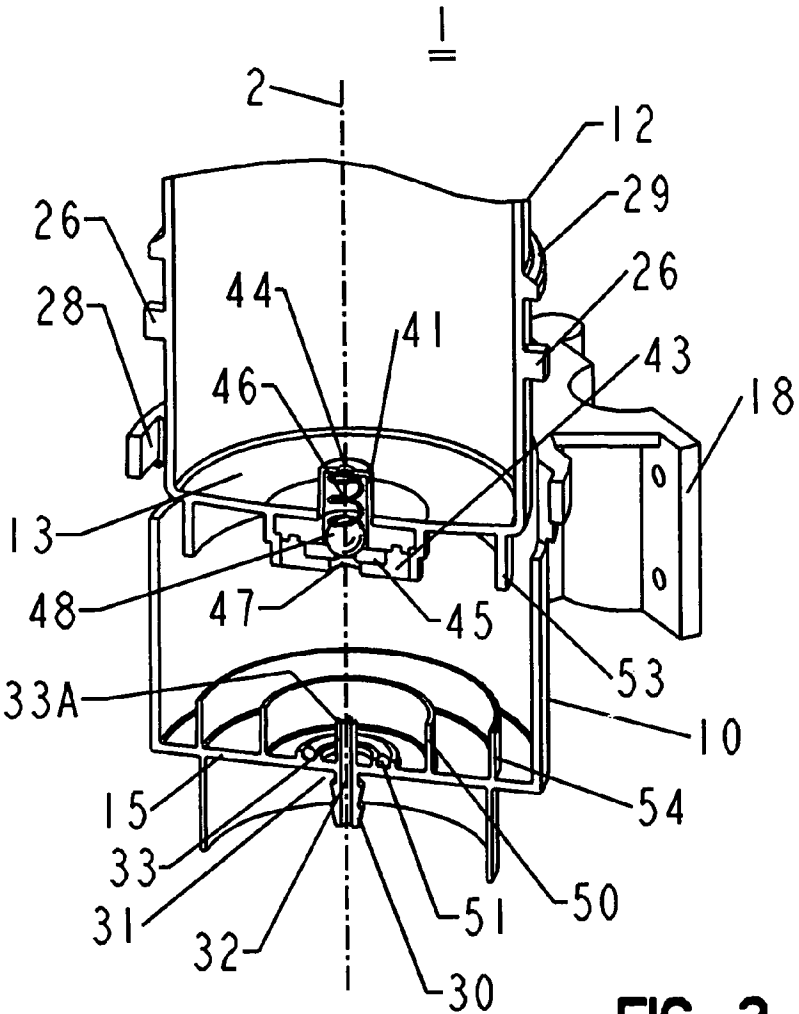
FIG. 2 is an axial exploded section of the fluid flow assembly according to FIG. 1 in an exploded representation.
Figure 3:
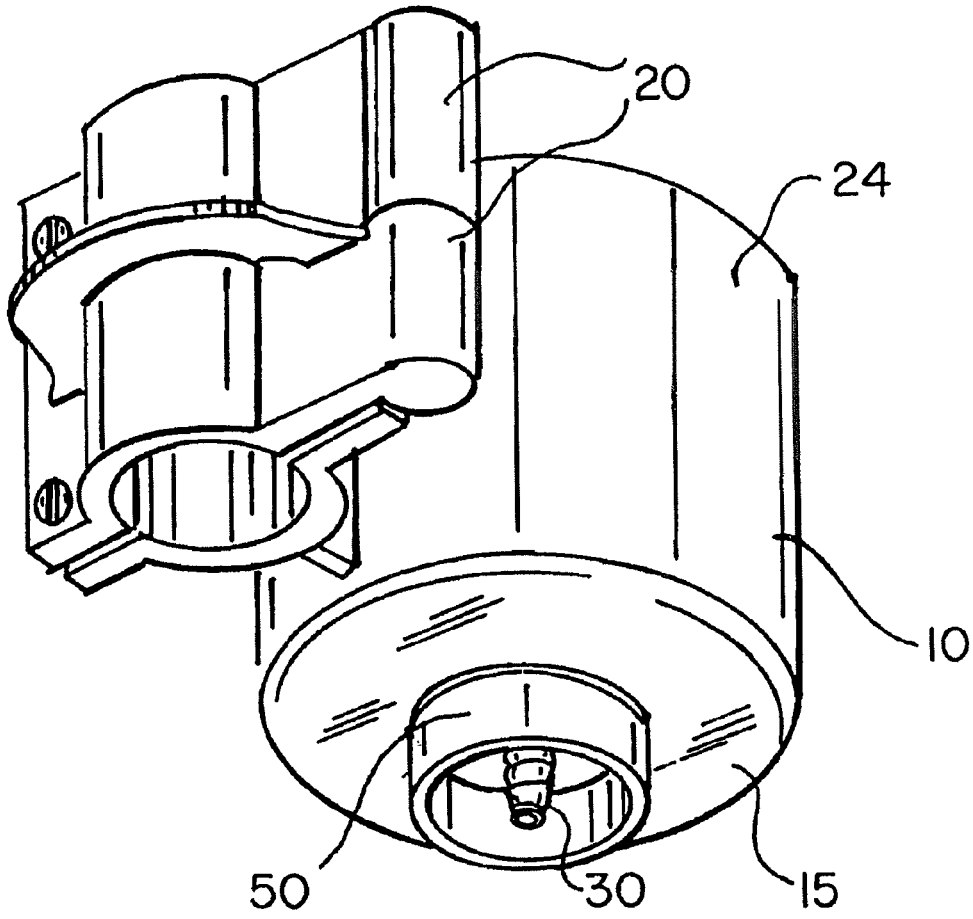
FIG. 3 shows the fluid coupling and retaining cylinder of the cleaning device from FIG. 1, seen from the underside thereof.

As shown in FIGS. 2 and 2A, fluid coupling and retaining cylinder 10 includes a base 15 and is generally pot-shaped. After a rotational movement about longitudinal axis 2 of storage container 12, a simultaneous axial (typically downward) and rotational displacement of storage container 12 occurs by which it can be reliably secured within cylinder 10, as is more fully described below. Storage container 12 can be readily removed from cylinder 10 by a corresponding opposite rotational and axial movement such that bayonet projections 26 are removed from bayonet apertures 28. Further connection and engagement between storage container 12 and cylinder 10 are more fully described hereinafter.

Storage container 12 of the present invention includes a ball valve assembly 40 disposed at a base 13 of the storage container for dispensing the cleaning fluid contained in storage container 12, through a fluid outlet 31 of cylinder 10, to other portions of the cleaning device.

As shown in FIGS. 2 and 2A, ball valve assembly 40 has an upper housing 41 protruding upwardly from the plane of base 13 and a lower extension 42 protruding downwardly from the plane of base 13. Upper housing 41 has an inlet aperture 44 at the upper end thereof. As shown, ball valve assembly 40 has a valve spring 46, a valve ball 48, and an annular sealing gasket 45, all centrally, axially disposed within upper housing 41 and lower extension 42, along longitudinal axis 2 of storage container 12. Annular sealing gasket 45 has a center opening centrally and axially aligned with valve ball 48, which forms the outlet port 47 of ball valve assembly 40. Annular sealing gasket 45 is secured to lower extension 42 by a seal holder 43, which has a snap rim 43A at the upper end. Seal holder 43 is snapped into the interior of lower extension 42, which holds annular sealing gasket 45 in place. Seal holder 43 has a center opening, also centrally and axially aligned with outlet port 47.

Annular sealing gasket 45 is made of an elastomeric material, of which the peripheral area adjacent to outlet port 47 comes in contact with valve ball 48 when ball valve assembly 40 is in the closed position.

The fluid coupling and retaining cylinder 10 has a hollow elongate fluid outlet 31 that is centrally, axially disposed within and through base 15 of cylinder 10, within which is a fluid channel 32. The upper portion of hollow elongate fluid outlet 31 is a male coupling 33 extending upwardly from base 15 and the lower portion of fluid outlet 31 is a connection nipple 30 extending upwardly from base 15. Fluid outlet 31 and fluid channel 32 therein are aligned co-axially with ball valve assembly 40. Male coupling 33 engages with ball valve assembly 40 of storage container 12, as described fully below, and connection nipple 30 is to be connected to a tubing (not shown) for delivery of the cleaning fluid from storage container 12 to other portions of the cleaning device for dispensing.

Figure 4A:
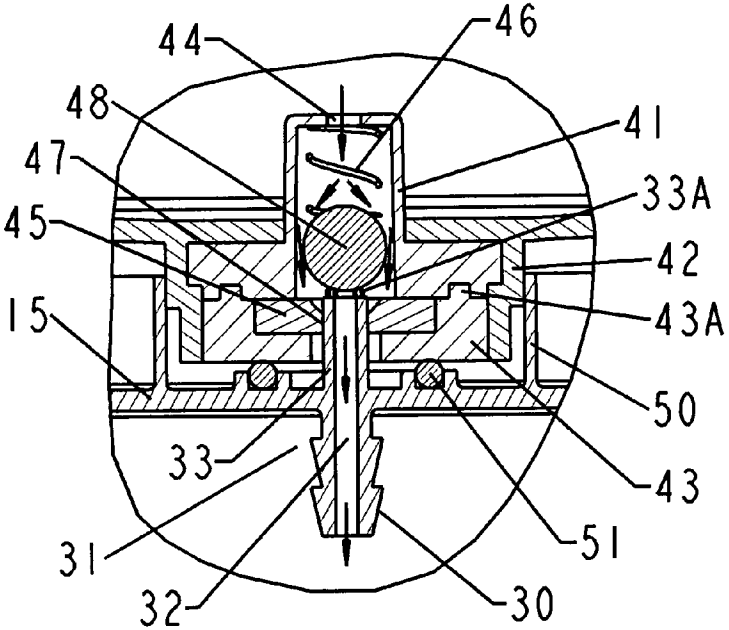
FIG. 4A is an enlarged view of the fluid flow assembly shown in FIG. 4, showing the ball valve assembly at its open position and the fluid flow within the fluid flow assembly.
Figure 4:
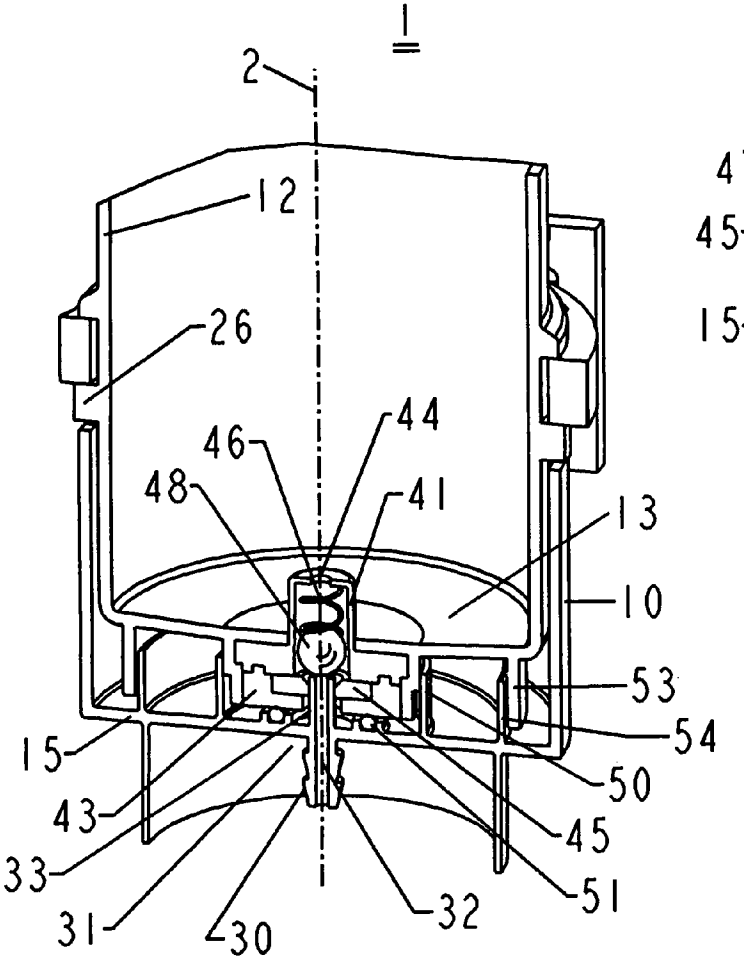
FIG. 4 is an assembly view of the fluid flow assembly of FIG. 1 with the ball valve assembly at its open position.

As shown in FIGS. 4 and 4A, when storage container 12 is connected to cylinder 10, male coupling 33 enters into outlet port 47 at the axial center of annular sealing gasket 45, lifts valve ball 48 against a resetting spring force, and hence moves ball valve assembly 40 from its closed position into an open position.

As shown, on the upper end of male coupling 33 there are four teeth 33A protruding from the upper end, which are in contact with valve ball 48 when ball valve assembly 40 is in the open position. Teeth 33A support valve ball 48 slightly above the circumferential upper end of male coupling 33, therefore, allow the cleaning fluid flowing into fluid channel 32. Furthermore, teeth 33A ensure axial positioning of the ball during fluid flow, which facilitates a stable through-flow connection from the storage container 12 to fluid channel 32 of male coupling 33. However, it should be understood that other suitable structures can also be used to support valve ball 48, yet maintain the fluid flow. For example, the upper end of male coupling 33 can have non-circumferential bearing webs for supporting the valve ball.

Therefore, a flow-through connection is established between fluid channel 32 of male coupling 33 and the internal space of ball valve assembly 40 of storage container 12 when male coupling 33 axially penetrates and displaces valve ball 48 out of a closed position, enabling fluid flow (see arrows in FIG. 4A) from the inside of storage container 12 through inlet aperture 44, passing valve spring 46 and valve ball 48, thru outlet port 47, into fluid channel 32 of male coupling 33. Therefore, as can be appreciated that in terms of functions, ball valve assembly 40 of the storage container is a coupling piece in the instant flow fluid assembly and male coupling 33 of cylinder 10 is a coupling counter-piece. The fluid tight connection between these two components provides a leak-free fluid line between the storage container and the fluid coupling and retaining cylinder.

The length of male coupling 33 is adjusted to the axial setting path of the valve ball 48, whereby a dimensional tolerance of, for example, +/−5 mm for the length of male coupling 33 is permissible, on the one hand to allow for manufacturing tolerances and, on the other, to ensure the reliable opening of the ball valve assembly by male coupling 33.

Furthermore, on the base 15 of cylinder 10 a sealing ring 51 is provided within a sealing ring groove disposed at a radial distance interval from male coupling 33. As shown in FIGS. 4 and 4A, in the open position of the ball valve assembly, sealing ring 51 is in contact with the bottom surface of sealing holder 43, which forms part of the lower extension 42 of ball valve assembly 40, which provides an additional sealing between storage container 12 and cylinder 10.

As shown in FIGS. 2, 4 and 4A, cylinder 10 has a circumferential guide wall 50 protruding upwardly from base 15, and co-axially aligned with fluid outlet 31 of cylinder 10. When storage container 12 is connected to cylinder 10, lower extension 42 can be inserted into guide wall 50. In this process, circumferential guide wall 50 interacts with lower extension 42 of storage container 12 as an axial or rotary guide, thereby the insertion of storage container 12 into cylinder 10 is simplified. Therefore, as can be appreciated, in addition to the function of a ball valve, the lower extension 42 of the instant ball valve assembly further functions as a positioning or guiding means for proper engagement between the storage container and the fluid coupling and retaining cylinder.

When it is necessary to change storage container 12, the bayonet connections 24, 26 and 28, above described, are simply counter-rotated and pulled apart such that storage container 12 can be released, thereby returning ball valve assembly 40 to its closed position shown in FIG. 2A. Consequentially, storage container 12 is tightly sealed as soon as it is taken out of cylinder 10 and thereby it is possible to readily remove a partially emptied storage container without escape of the cleaning fluid contained inside the storage container.

As shown FIGS. 4 and 4A, center opening of annular sealing gasket 45 can be designed to form a truncated cone at the upper end. When the ball valve assembly is in the closed position, valve ball 48 rests on the cone area, which offers an increased surface contact between the valve ball and the sealing gasket, hence, provides an enhanced sealing.

As can be appreciated, by means of the ball valve, when male coupling 33 is removed, the ball valve assembly automatically moves into its closed position because of the resetting spring force. Therefore, the storage container is closed when it is removed from the fluid coupling and retaining cylinder, avoiding unintentional emergence of cleaning fluid, permitting a partially emptied storage container to be stored in a closed state.

To provide better mounting of the storage container, provision is made for fluid coupling and retaining cylinder 10 to be shaped in the form of a pot, so that storage container 12 can be inserted area by area into the pot-shaped element, meaning the storage container is surrounded on the peripheral side by the fluid coupling and retaining cylinder 10 and over a partial section of its axial extension. Even in the event of a shock impact, the storage container is then secured against slipping or unintentional release from cylinder 10.

To provide additional support for storage container 12 and to improve retention relative to cylinder 10, an additional mounting wall 54 is provided which also projects upwardly from base 15 of cylinder 10, but is arranged at a radial interval concentrically about circumferential guide wall 50. On the other hand, storage container 12 also has a counter wall 53 projecting downwardly from base 13 of the storage container. Mounting wall 54 of cylinder 10 and counter wall 53 are in a vertical mating position when they are engaged. Therefore, when storage container 12 is connected to cylinder 10, not only lower extension 42 is mounted into guide wall 50, mounting wall 54 of cylinder 10 is also mounted into counter wall 53 of storage container 12 (see FIGS. 2 and 4). Thus any tilting movement of the storage container 12 is counteracted.

It is preferable that guide wall 50 and additional mounting wall 54 are designed as circular and, in particular, concentric to the pot-shaped fluid coupling and retaining cylinder. In the embodiment shown, guide wall 50 and additional mounting wall 54 of cylinder 10 are circular, which facilitates precision of co-axial relationship with lower extension 42 of ball valve assembly 40 of storage container 12 on the one hand and circumferential counter wall 53 on the other. The result of the above structure is to assure problem free insertion of storage container 12 into cylinder 10 such that removal from it can be achieved by a rotational movement of bayonet projections 26 relative to bayonet apertures 28. This strategy also provides protection against not only possible misalignment of the storage container and the cylinder by a technician but, as well, against potential leakage due to wear or external impact upon the coupling region between the storage container and the cylinder. As can be appreciated, if a minimum amount of leakage occurs due to wear or external impact, the cleaning fluid can be restrained within the guide wall. Therefore, contamination of the cylinder or emergence of cleaning material is thus avoided.

The fluid coupling and retaining cylinder 10 with guide wall 50 and mounting wall 54 can be manufactured easily and economically, for example, as an injection-molded component.

Figure 5:
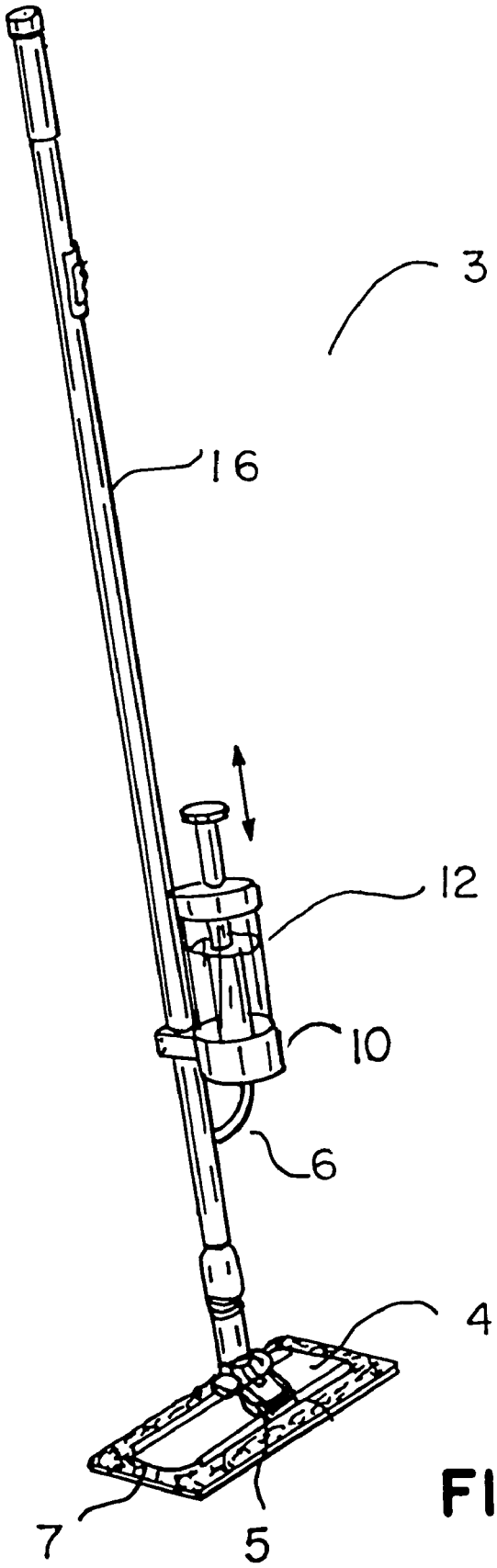
FIG. 5 shows a mop utilizing the fluid flow assembly of the present invention for supplying the cleaning fluid.

FIG. 5 illustrates an example of a cleaning device which employs the fluid flow assembly of the present invention. As shown, the cleaning device is a mop 3 with fluid flow assembly 1 connected to handle rod 16. The distal end of handle rod 16 is connected to a mop head 4, shown as a flat mop head, which has a cleaning pad 7 attached thereto. A spray head 5 is attached to the upper surface of mop head 4. A tubing 6 is connected to nipple connection 30 of cylinder 10 at one end, the other end connects to a dispensing valve (not shown) disposed inside handle rod 16, which in turn fluidly connects to spray head 5. Therefore, upon connecting storage container 12 to cylinder 10, the cleaning fluid inside storage container 12, can be delivered to spray head 5 for spraying on the floor for cleaning. In an alternative structure, the spray head of the mop can be connected adjacent to the distal end of the handle rod. Further structural details of the cleaning device have been described in co-pending U.S. patent application Ser. No. 11/372,924, which is herein incorporated by reference in its entirety.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

What is claimed is:

1. A fluid flow assembly comprising: (a) a storage container having a base and a ball valve assembly axially disposed at said base along a longitudinal axis of said storage container, the ball valve assembly including a spring that biases a valve ball against a sealing gasket; and (b) a fluid coupling and retaining cylinder having a base and an axial hollow elongate fluid outlet co-axially aligned with said ball valve assembly of said storage container, said fluid outlet having a male coupling extending upwardly from said base of said cylinder, wherein when said base of said storage container is connected to said fluid coupling and retaining cylinder, said male coupling penetrates into an outlet port of said ball valve assembly of said storage container, and axially displaces the valve ball of said ball valve assembly against a force of the spring from a closed position into an open position, enabling a fluid flow from said storage container, through said ball valve assembly, into said hollow fluid outlet, the ball valve assembly is located in a cylindrical lower extension that protrudes downwardly from the base of the container, and a complementary co-axial circumferential guide wall extends upwardly from the base of the fluid coupling and retaining cylinder, and the cylindrical lower extension engages in the co-axial circumferential guide wall as the base of the storage container is connected to the fluid coupling and retaining cylinder to guide the male coupling into the outlet port, and a sealing ring is located on the base of the fluid coupling and retaining cylinder when said base of said storage container is disconnected from said fluid coupling and retaining cylinder, and the sealing ring is in contact with a lower surface of the cylindrical lower extension when the base of the storage cylinder is connected to the fluid coupling and retaining cylinder, and when the ball valve assembly is in the open position, the sealing ring provides an additional seal.

2. The fluid flow assembly as recited in claim 1, wherein said ball valve assembly includes an upper housing protruding upwardly from said base of said container having an inlet aperture at an upper end of said housing; and said valve spring, said valve ball, and said sealing gasket, all are centrally, axially disposed within said upper housing and said lower extension; said sealing gasket being annular and having a center opening, centrally and axially aligned with said valve ball, forming said outlet port of said ball valve assembly.

3. The fluid flow assembly as recited in claim 2, wherein said ball valve assembly is in said closed position when said storage container is removed from said fluid coupling and retaining cylinder, wherein said valve ball seats on said annular sealing gasket and closes said outlet port of said ball valve assembly.

4. The fluid flow assembly as recited in claim 1, wherein said male coupling has multiple teeth on an upper end thereof for supporting said valve ball when said ball valve assembly is in said open position.

5. The fluid flow assembly as recited in claim 1, wherein said fluid coupling and retaining cylinder further comprises a mounting wall extending upwardly and axially from said base thereof, disposed at a radial distance interval from said guide wall, and said storage container further comprises a circumferential counter wall extending downwardly from said base of said storage container for axially engaging with said mounting wall of said cylinder.

6. The fluid flow assembly as recited in claim 1, wherein fluid coupling and retaining cylinder has a pot-shaped geometry.

7. The fluid flow assembly according to one of claim 1, wherein said fluid coupling and retaining cylinder has a bayonet aperture, and a circumferential side of said storage container has at least one bayonet projection for connecting to said bayonet aperture of said fluid coupling and retaining cylinder by a bayonet fitting.

8. The fluid flow assembly as recited in claim 1, wherein said storage container further comprises a circumferential ridge for controlling an extent of axial insertion of said storage container into said fluid coupling and retaining cylinder.

9. A cleaning device comprising: (a) a handle rod having a distal end, (b) a flat mop head connected to said distal end of said handle rod; (c) a spray head; and (d) a fluid flow assembly attached to said handle rod, said fluid flow assembly comprising: a storage container having a base and a ball valve assembly axially disposed at said base along a longitudinal axis of said storage container, the ball valve assembly including a spring that biases a valve ball against a sealing gasket; and a fluid coupling and retaining cylinder having a base and an axial hollow elongate fluid outlet co-axially aligned with said ball valve assembly of said storage container, said fluid outlet having a male coupling extending upwardly from said base of said cylinder, and a connection nipple extending downwardly from said base of said cylinder, and said connection nipple connected to said spray head by a tubing, wherein when said base of said storage container is connected to said fluid coupling and retaining cylinder, said male coupling penetrates into an outlet port of said ball valve assembly of said storage container, and axially displaces the valve ball of said ball valve assembly against a force of the spring from a closed position into an open position, enabling a fluid flow from said storage container, through said ball valve assembly, into said hollow fluid outlet, and downstream thereof, the ball valve assembly is located in a cylindrical lower extension that protrudes downwardly from the base of the container, and a complementary co-axial circumferential guide wall extends upwardly from the base of the fluid coupling and retaining cylinder, and the cylindrical lower extension engages in the co-axial circumferential guide wall as the base of the storage container is connected to the fluid coupling and retaining cylinder to guide the male coupling into the outlet port, and a sealing ring is located on the base of the fluid coupling and retaining cylinder when said base of said storage container is disconnected from said fluid coupling and retaining cylinder, and the sealing ring is in contact with a lower surface of the cylindrical lower extension when the base of the storage cylinder is connected to the fluid coupling and retaining cylinder, and when the ball valve assembly is in the open position, the sealing ring provides an additional seal.

10. The fluid flow assembly as recited in claim 9, wherein said ball valve assembly includes an upper housing protruding upwardly from said base of said container having an inlet aperture at an upper end of said housing; and said valve spring, said valve ball, and said sealing gasket, all are centrally, axially disposed within said upper housing and lower extension; said sealing gasket being annular and having a center opening, centrally and axially aligned with said valve ball, forming said outlet port of said ball valve assembly.

11. The fluid flow assembly as recited in claim 10, wherein said ball valve assembly is in said closed position when said storage container is removed from said fluid coupling and retaining cylinder, wherein said valve ball seats on said annular sealing gasket and closes said outlet port of said ball valve assembly.

12. The fluid flow assembly as recited in claim 9, wherein said male coupling has multiple teeth on an upper end thereof for supporting said valve ball when said ball valve assembly is in said open position.

13. The fluid flow assembly as recited in claim 9, wherein said fluid coupling and retaining cylinder further comprises a mounting wall extending upwardly and axially from said base thereof, disposed at a radial distance interval from said guide wall, and said storage container further comprises a circumferential counter wall extending downwardly from said base of said storage container for axially engaging with said mounting wall of said cylinder.

14. The fluid flow assembly as recited in claim 9, wherein fluid coupling and retaining cylinder has a pot-shaped geometry.

15. The fluid flow assembly according to one of claim 9, wherein said fluid coupling and retaining cylinder has a bayonet aperture, and a circumferential side of said storage container has at least one bayonet projection for connecting to said bayonet aperture of said fluid coupling and retaining cylinder by a bayonet fitting.

16. The fluid flow assembly as recited in claim 9, wherein said storage container further comprises a circumferential ridge for controlling an extent of axial insertion of said storage container into said fluid coupling and retaining cylinder.

* * * * *